United States Patent [19]

Tsukube

[11] 4,076,179

[45] Feb. 28, 1978

[54] CENTRIFUGAL SEWAGE PUMP

[75] Inventor: Syozo Tsukube, Ikoma, Japan

[73] Assignee: Kabushiki Kaisha Sogo Pump Seisakusho, Osaka, Japan

[21] Appl. No.: 679,464

[22] Filed: Apr. 22, 1976

[51] Int. Cl.[2] ..... B02C 23/36

[52] U.S. Cl. ..... 241/46.11; 241/185 A; 415/213 A

[58] Field of Search ..... 241/46.11, 46.17, 185 A; 415/213 A, 121 B

[56] References Cited

U.S. PATENT DOCUMENTS

| | | | |
|---|---|---|---|
| 3,096,718 | 7/1963 | Anderson | 241/185 A |
| 3,167,021 | 1/1965 | Sence | 415/213 A |
| 3,973,866 | 8/1976 | Vaughan | 241/46.11 |

*Primary Examiner*—Granville Y. Custer, Jr.

*Attorney, Agent, or Firm*—Durns, Doane, Swecker & Mathis

[57] ABSTRACT

This invention relates to a centrifugal sewage pump of a torque flow type having a hollow depressed backward curve in front of a shroud of an impeller, in which an outer periphery portion of a vane is projected into a water passage for the purpose of improving a pumping head and pump efficiency and simultaneously for the purpose of avoiding pump clogging caused by fibriform solid matter adhering to the front edge of the vane. In order further securely to avoid clogging of the pump due to fibriform solid matter, a cutter plate or guide plate is provided alongside the flow line, to remove fibriform solid matter from said vane front edge, so that they can be positively discharged outward. By providing a shoulder on the outer periphery of the vane projecting into the water passage, the pump permits free adjustment of pumping head without changing pump rotational speed.

8 Claims, 15 Drawing Figures

CENTRIFUGAL SEWAGE PUMP

This invention relates to a centrifugal sewage pump for use in a sanitary sewage treatment system installed in buildings and cities.

In the conventional torque flow-type sewage pump the design of a pump casing, and semi-open impeller including a shroud and plural impeller vanes (or blades) in one body has been such that the vertex between the impeller vanes (or blades) was apt to stagnate in the clearance in front of the radial flow impeller vanes. Also, long fibers, pieces of cloth and like objects were apt to collect at a central part of the impeller thereby causing clogging of the pump. There was a tendency, further, for fiber to be caught at a relatively prominent projection at the swirling-in portion of the volute casing marking the junction of casing and discharge passageway.

An object of the present invention is to avoid the above-mentioned disadvantage. In other words, a principal object of this invention is to quickly discharge a vortex formed in the hollow in front of the radial flow impeller vanes in order to prevent clogging caused by solid matter; at the same time, to improve pumping head and pump efficiency.

In order to accomplish this object, in this invention the length of the vane outer periphery is enlarged and the outer periphery is projected into a water passage larger than a certain value in order to positively drive the vortex by means of the vane outer periphery to give a large centrifugal force thereto. Quick discharge of vortex not only improves the pumping head and pump efficiency, but also removes possibility of solid matter, especially fibers, stagnating at and adhering to the vane front edge. Further, fibers once covering the vane front edge can quickly be discharged together with the vortex.

The shroud front face is divided into six partial faces each in front of the impeller. As another countermeasure, a hollow in front of an impeller is omitted. In this construction a division (or plural divisions) without the hollow produces no vortex, thus obtaining a water stream the same as that obtained in a conventional centrifugal pump. Consequently, the above-mentioned annular vortex flow is partitioned or divided into sections by the water stream, i.e. the pump becomes a compound type in combining features of a centrifugal pump with those of a torque flow pump. This construction improves the pumping head and pump efficiency; at the same time, by means of said water stream positively discharges fibriform solid matter which tends to adhere to the vane front edge.

As another, further, countermeasure, the swirling-in portion of the volute chamber is widened to eliminate a sharp-edged projection inside the casing. This can prevent the swirling-in portion from being clogged.

Another object of the invention is to positively tear solid matter by utilizing rotation of the impeller. As a means to this end, at an inside face of a casing opposing the vane front edge, one or more cutter plates or guide plates are provided projecting against the vane front edge. The above-mentioned cutter plates forcibly peel off solid matter, e.g., fibers, carried and covered on the vane front edge, move the same outward along with water and solid and, during this time, forcibly tear fibers by relative motion between the impeller vanes and the cutter plates. According to this countermeasure solid matter such as broken fibers after once leaving the cutter plate are quickly discharged without subjected to cracking effect between the cutter plate and vane front edge again, so that there is no possibility of unnecessarily fine tearing of solid matter, and wear of vane front edge and power loss can be kept as low as possible.

A further inventive object is to freely change the pumping head without changing the pump rotational speed. This object can be accomplished by decreasing an outer diameter of the vane outer periphery projected into the water passage by means of lathe machining, etc.

These and other objects and features of this invention will be better understood upon consideration of the following detailed description, taken with the accompanying drawings, in which.

Figure 4:
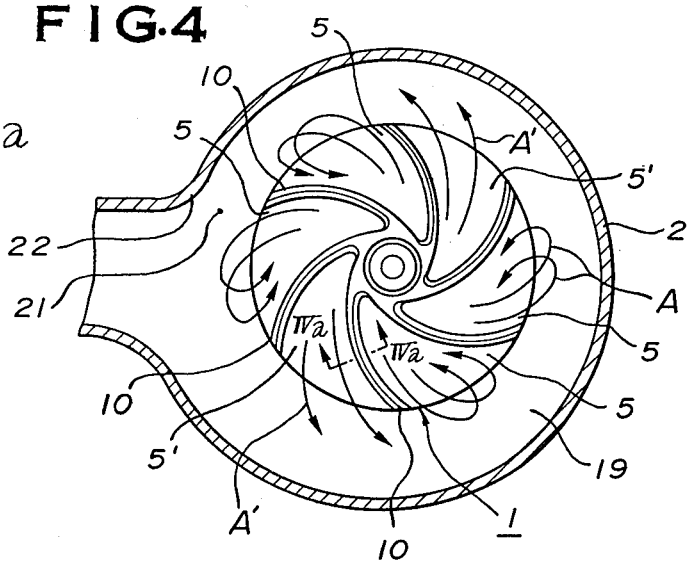
FIG. 4 is a sectional view taken substantially on the line IV—IV of FIG. 3.
Figure 4A:
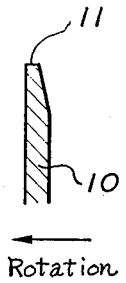
Figure 5:
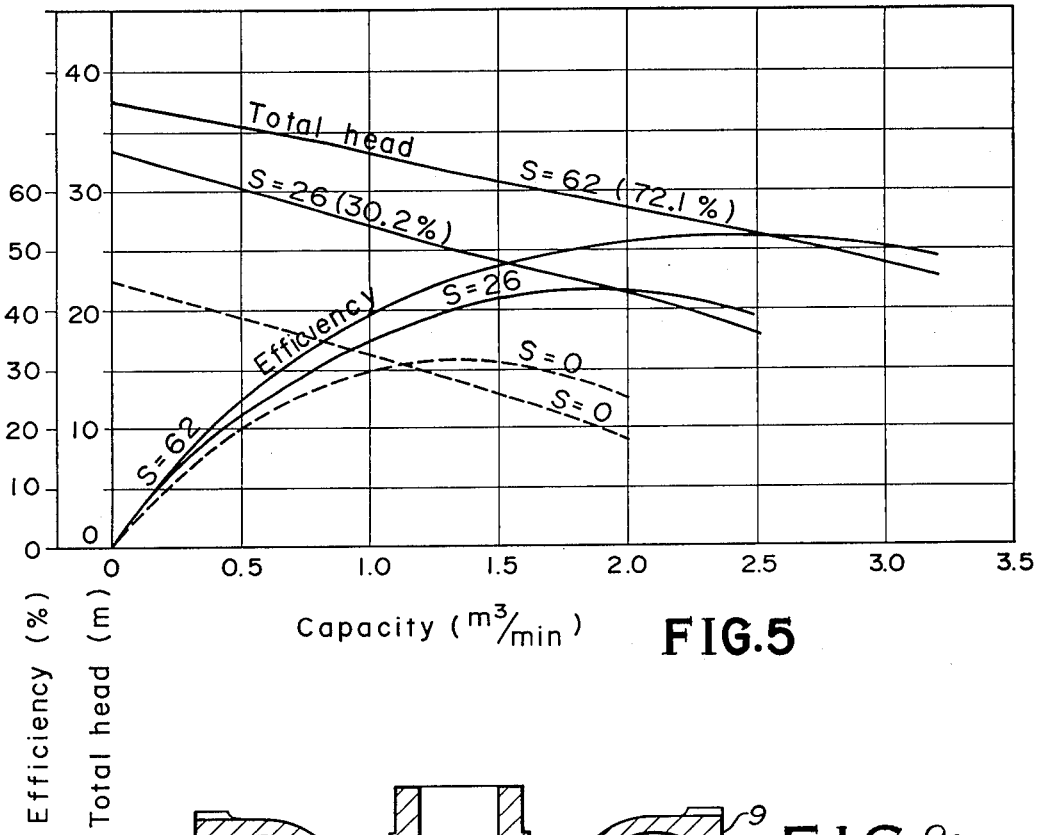
Figure 8:
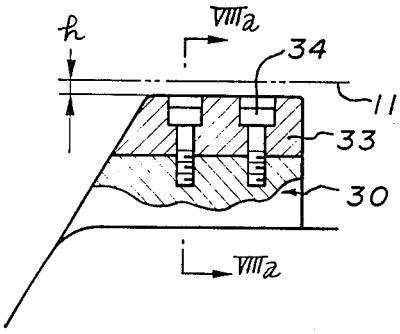
Figure 6:
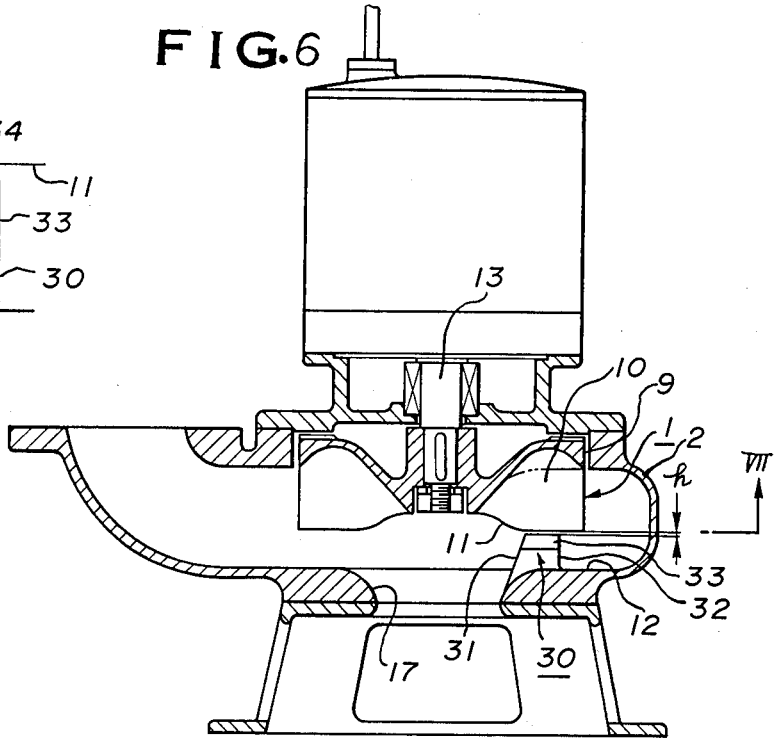
Figure 8A:
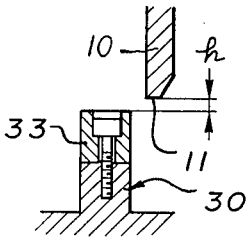
Figure 7:
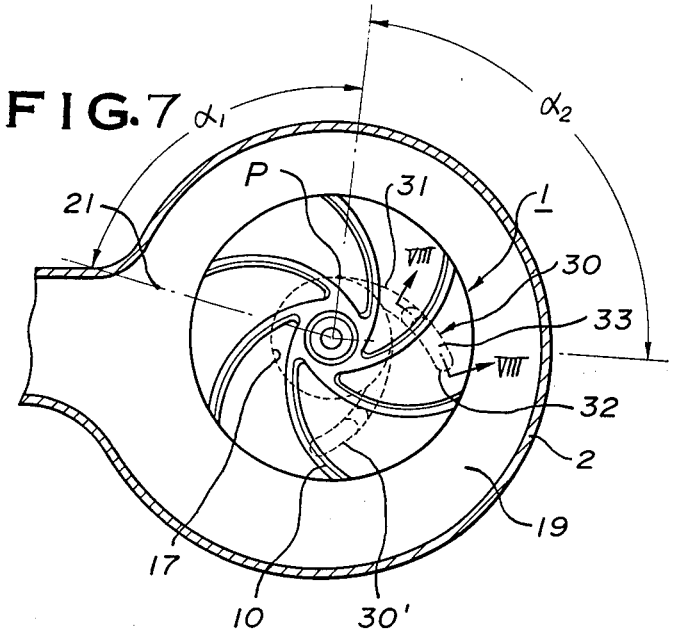
Figure 8B:
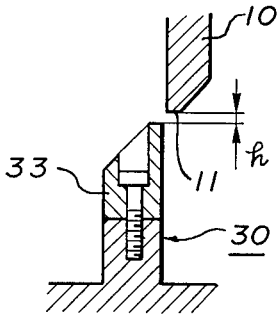

FIG. 4*a* is a sectional view taken on the line IV*a*—IV*a* of FIG. 4;

FIG. 5 is a diagram showing comparative performance of a pump of the present invention and a conventional pump;

FIG. 6 is a vertical sectional view showing another embodiment of the invention;

FIG. 7 is a sectional view taken substantially on the line VII—VII of FIG. 6;

FIG. 8 is an enlarged sectional view taken on the line VIII—VIII of FIG. 7;

FIG. 8*a* is a sectional view taken on the line VIII*a*—VIII*a* of FIG. 8; FIG. 8*b* is a modified sectional view of the section VIII*a*—VIII*a;*

Figure 9A:
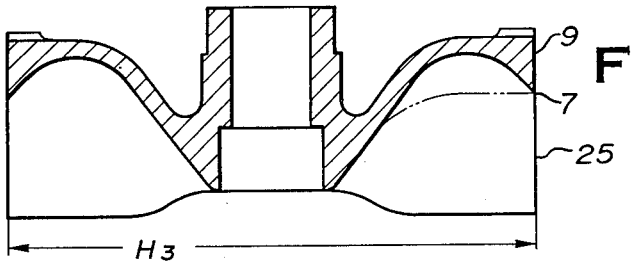
Figure 9B:
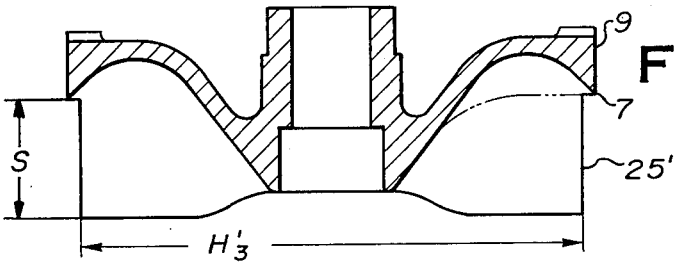
Figure 9C:
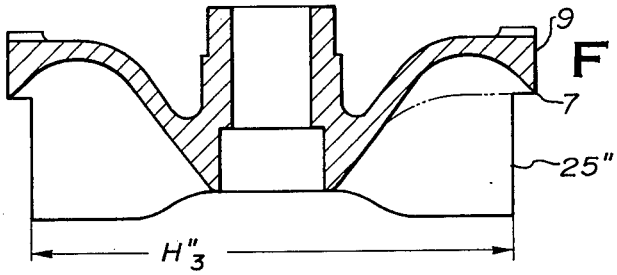
Figure 10:
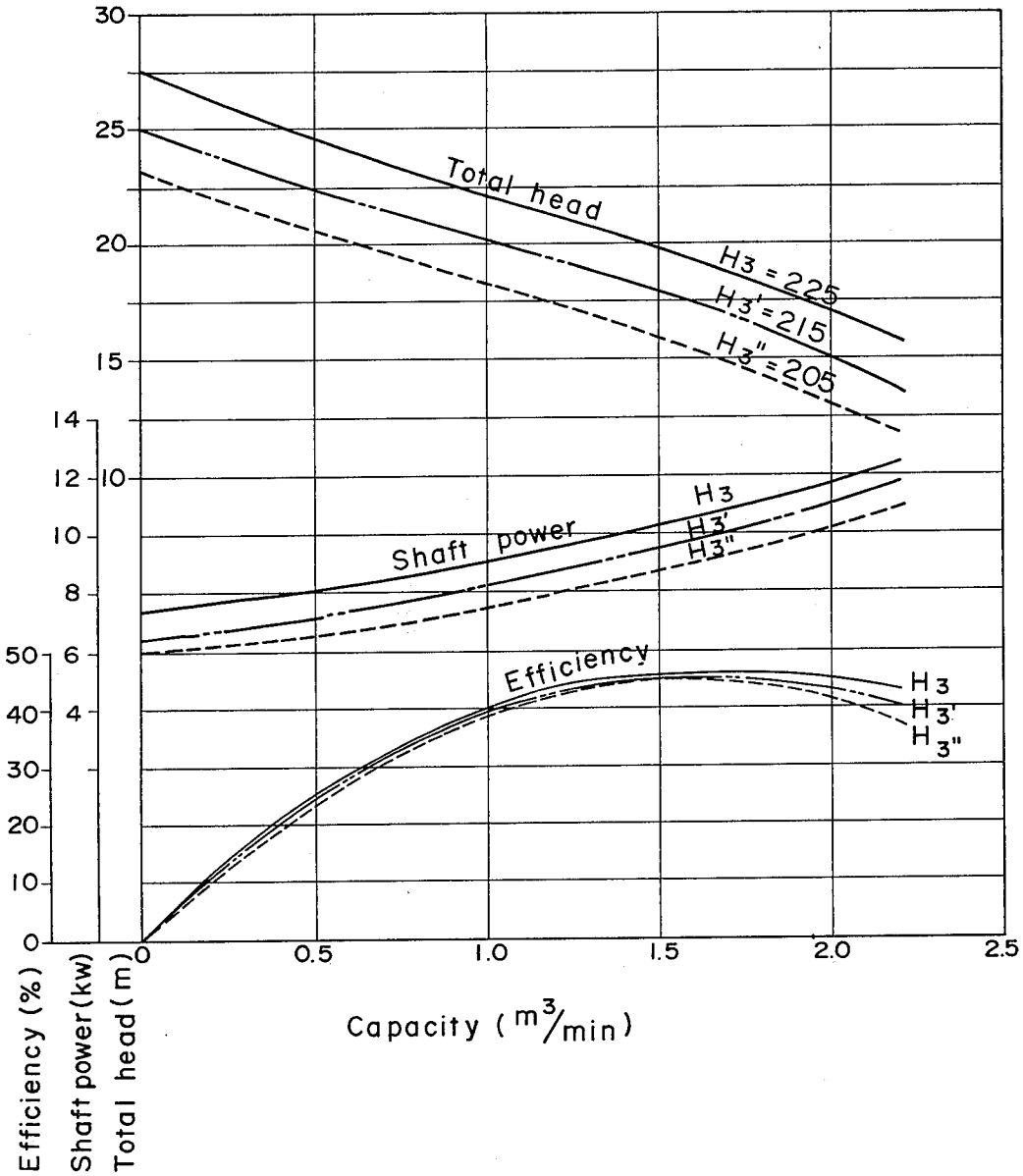

FIGS. 9*a,* 9*b* and 9*c* are vertical sectional views showing the impeller in FIG. 6 and two species of impeller having different outer diameters; and FIG. 10 is a diagram showing comparative performance using vanes illustrated in FIG. 9*a* - 9*c.*

Figure 1:
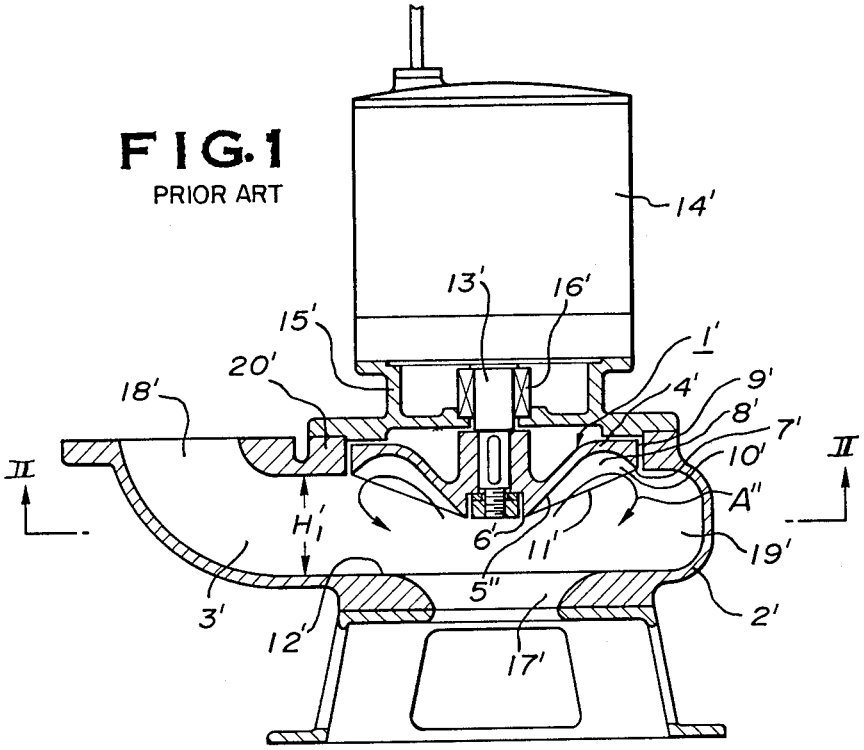
FIG. 1 PRIOR ART
FIG. 1 is a vertical sectional view of a conventional (prior art) torque flow type pump.
Figure 2:
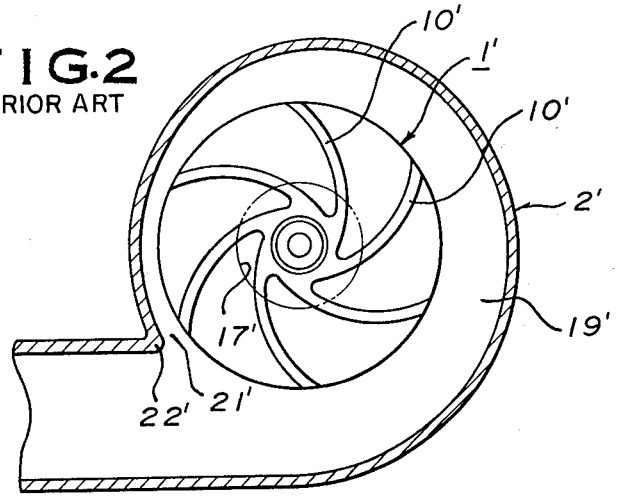
FIG. 2 PRIOR ART
FIG. 2 is a sectional view taken substantially on the line II—II of FIG. 1.
Figure 3:
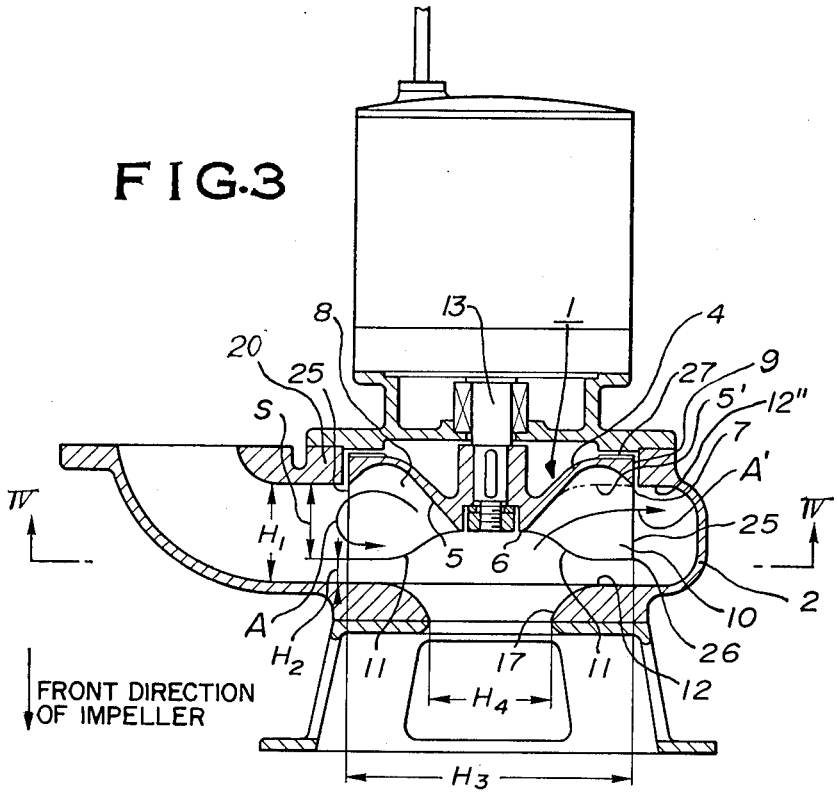
FIG. 3 is a vertical sectional view of a pump in accordance with the present invention.

In FIGS. 3 and 4, the same numerals as in FIGS. 1 and 2 (but without single and double primes) show corresponding parts.

A torque flow type pump for the purpose of transporting water including solid matter, as shown in FIG. 1, has already been adopted. In the torque flow type of submerged pump as illustrated in the figure, as impeller 1' is so arranged as to face with a watercourse 3' in a pump casing 2', a front face 5'' of a shroud 4' provides a hollow 8' curving smoothly backward (upward in the figure) between an inner edge 6' and outer edge 7'. A shroud outer periphery 9' is covered with a shroud ring 20' of the pump casing 2', and a large clearance $H_1'$ for passing solid matter is provided between a front edge 11' of a radial flow impeller vane (or blade) 10 and a casing inner face 12'. 13' is a pump shaft or drive shaft on the tip end of which the impeller 1' is fixed. The shaft illustrated in FIG. 1 is an output shaft of a submerged motor 14'. Part 15' is a motor bed which is fixed on the pump casing 2', the submerged motor 14' being mounted thereon. 16' is a mechanical seal between the motor bed 15' and the pump shaft 13'; 17' is a suction port provided on the pump casing; 18' is a discharge port and 19' is a volute chamber.

When the impeller 1' is rotated, water induced from the suction part 17' comes in between radial flow impeller vanes 10' and 10' to be applied with centrifugal force, and forms a vortex as shown by an arrow A'' between impeller vanes 10' and 10' caused by streaming outward along the depressed shroud front face 5''. The vortex A'' produces annular vortex flow with the center at the pump shaft 13' driven by the radial flow impeller vanes 10' while acting as a radial flow impeller inside the clearance $H_1'$, gradually leaves the impeller 1' due to centrifugal force, and flows along the volute chamber 19' and out of the pump through the discharge port 18'.

According to the above-mentioned conventional construction, however, at an outer peripheral part of the impeller 1' the height of the radial flow impeller vane 10' gradually lowers toward the outside to become zero finally at the outer edge 7'. Therefore a function of the radial flow impeller vanes as a centrifugal pump, i.e. a function applying centrifugal force to fluid which flows between radial flow impeller vanes 10' and 10' is weakened, the vortex A'' is apt to stagnate at the clearance $H_1'$ in front of the radial flow impeller vanes 10', and increasing the water flow is difficult as compared with a centrifugal pump having the same pumping head. Further, long fibers and cloth are thrust against the vane front edge 11' at a central part of the impeller 1', due to an effect of the vortex A'', slow discharge of the vortex A'' obstructs quick exhausts of fibers covering the vane front edge thereby causing clogging of the pump. Since the impeller 1' has little ability to tear solid matter, the pump is subject to being clogged much more when solid matter larger than the clearance of vane front $H_1'$ is sucked in.

In the conventional pump a considerably sharp-edged projection 22' (FIG. 2) is provided in a pump casing 2' to narrow a swirling-in portion 21' of the volute chamber 19', so that there is a disadvantage that fibers are apt to be caught at the projection 22'.

A radial flow impeller vane 10 of FIG. 3 provides a vane outer periphery 25 (height:S) projecting from a shroud front outer peripheral edge 7 along a water passage forward (downward in the figure) and a front edge 11 running from a front end 26 of the vane outer periphery 25 to an inner edge 6 of the shroud front face. Part 5' of FIG. 3 is a shroud front face which does not form the hollow 8, being provided in two places at exactly symmetrical positions with the pump shaft 13 at their center. This state is clearly shown in FIG. 4. The front face 5' does not provide the hollow 8 so that the vortex A is not formed there, and water flow A' is formed instead of that. Part 27 is a radial back rib provided on the impeller wheel 1.

In FIG. 4 a swirling-in portion 21 of the volute chamber 19 is sufficiently widened so as to permit solid matter to pass therethrough easily without being caught on a smooth projection 22 of a casing 2.

In FIGS. 3 and 4 a shroud front face 5 is depressed backward (as in FIG. 1) so that water including solid matter induced from a suction port 17 in between radial flow impeller vanes 10, 10 is driven by the impeller vanes 10 to partially flow along the backward depressed front face 5, and a vortex A functioning as a fluid impeller vane is formed the same as with the conventional type of FIG. 1. The vortex A formed between the impeller vanes 10, 10 and annular spiral flow comprising a plurality of the vortexes A are forcibly accelerated by means of a vane outer periphery projecting into the water passage. Further, since a discharging plane of each vane outer periphery 25 is opened outward, the vortex A is quickly discharged while functioning as if it was an impeller vane. Comparing with a conventional torque flow type pump having the same impeller outer diameter, the pumping head and pumping quantity are increased and the efficiency is improved.

A part of the water induced to the vane front face 5' which does not provide the hollow 8 is driven by the impeller vanes 10 to become water flow A' without forming the vortex A, thus being sent outward. Relative movement of the vortex A and water flow A' against the impeller wheel 1 is shown in FIG. 4. The vortex A is apt to rotate together with the impeller 1 to form the annular spiral flow, but the foregoing spiral flow is separated by the water flow A' at two places. By projecting the vane outer periphery into the water passage and by forming a part of the vane front face divided by the impeller 10 using a curved surface having no hollow 8 as shown by 5', the amount of the fibriform solid matter adhering to the vane front edge 11 can be decreased, or the fibriform solid matter can be quickly discharged even if the same begins to adhere, thus clogging preventive effect is improved.

According to test results mentioned below, a height S of the vane outer periphery 25 is considered to be proper in a region more than 30%, preferably 30–70% of the water passage clearance $H_1$ (FIG. 3) at a vane outlet portion of the casing. Should S be smaller than 30% of $H_1$, the effect of this invention is insufficient, i.e., the difference of performances between a conventional type and the present invention is not remarkable. A vane front clearance $H_2$ between the vane front edge 11 and pump casing inner face 12 opposing thereto can be taken sufficiently small, however, it is recommended to take 20 – 70% of the water passage clearance $H_1$ at the vane outlet portion in order to permit considerably large solids to pass therethrough. When the vane front edge 11 is sharpened as illustrated in FIG. 4*a*, tearing performance for solid matter is improved.

In FIG. 3, numeral 2 indicates a pump casing. Numeral 4 is a shroud, a disc like back wall from which plural impeller vanes 10 project in one body. 9 is a shroud outer periphery. 20 is a shroud ring formed in a part of the pump casing 2. In FIG. 4, numeral 1 indicates an impeller wheel.

FIG. 5 shows test results of pump performances in case of the vane outer peripheral height S being selected to be 62 mm, 26 mm and zero. In this case, pump outer dia. : $H_3 = 252$ mm, suction bore: $H_4 = 100$ mm, outlet clearance: $H_1 = 86$ mm, rotational speed: 1750 rpm. As seen from FIG. 5, both the pumping head and the efficiency are sharply improved as the vane outer peripheral height S is increased, and the effect is remarkable if S is more than 30% of $H_1$. Further, when fibriform solid matter having sizes of a towel is mingled, the pump is clogged in case of $S = 0$; however, it is confirmed that the pump is entirely free from clogging in case $S = 26$ mm and in case $S = 62$ mm.

In order positively to tear and subdivide the fibriform solid matter, in a pump shown in FIG. 6 there is provided a cutter plate 30 fixed to the casing 2 and projecting toward the vane front edge 11. The cutter plate 30 is curvedly arranged along the absolute flow path in the pump as shown in FIG. 7. An inner periphery 31 thereof is smoothly continuous with an inner surface of the suction port 17 (FIG. 6); and, viewing from the axial direction, it extends tangentially with the suction port 17 outward; the distance between the inner periphery 31 and center line of shaft 13 increases smoothly with increase in distance from the suction port 17, being curved alongside the absolute flow path. An outer periphery (edge) 32 thereof locates radially inside the outer periphery of the impeller 1, and the cutter plate 30 provides a cutter blade 33 at the tip end thereof. The circumferential position of the cutter plate 30 is so situated that an inner end point P of the cutter inner periphery 31 is disposed in a region 60° - 180° (i.e., from $\alpha_1$ to $\alpha_1 \alpha_2$) apart from the swirling-in portion 21 of the spiral chamber 19 in the pump casing 2. This is based on test results that performances such as pumping head and efficiency become worse if the point P is put nearer to the swirling-in portion 21. 30' shows an example where the cutter plate 30 is deviated within the above-mentioned region.

In case where fibriform solid matter sucked from the suction port 17 adheres to or is caught by the vane front edge 11 due to said vortex A when passing thereby during operation, solid matter is driven by the applied centrifugal force of the impeller and moves along the vane front edge 11 toward the exit. This material is peeled off from the vane front edge 11 by the cutter plate 30 on its way under the applied thrust force from the vane front edge 11 due to rotation of the impeller 1, it slides on the cutter plate 30 extending in the direction of the absolute flow path while being subjected to shearing force, thus passing by the cutter plate 30 to be discharged outward. During that time the solid matter is being subjected to tearing force between the cutter blade 33 of the cutter plate 30 and the vane front edge 11 to be converted to comparatively small and fluent particles of solid matter. Fibriform solid matter caught on the cutter plate's inner periphery 31 is subjected to thrust force from the water flow to move on the inner periphery 31 to a meeting portion of the vane front edge 11 and the cutter blade 33, thus being subjected to tearing effect because the inner periphery 31 is smoothly continuous with the suction port 17 and inclining toward downstream. The vane front edge 11 approaches to and meets with the cutter blade 33 intermittently, so that solid matter torn by one impeller vane 10 at the cutter blade 33 quickly leaves the cutter blade 33 to provide an instantaneous cutting process, and is quickly discharged without being subjected to repeated tearing effect from the vane 10.

The cutter blade 33 is fixed,— for example, as shown in FIG. 8,— to a body of the cutter plate 30 by means of two hexagonal socket bolts 34. A clearance *h* between the cutter blade 33 and vane front edge 11 is preferably taken to be 0.5 - 1 mm. In this case the cutting effect will be more improved if the cutter blade 33 is gradually thinned toward the tip end and sharpened thereat as with the vane front edge 11 in FIG. 8*b*. When the cutter blade 33 is worn out, thereby increasing the clearance *h* to about 4 - 5 mm during operation, the meeting portion of the cutter blade 33 and vane front edge 11 can still tear comparatively large cloth-like solids, but has little shearing effect, thus the cutter plate 30 begins to function as a guide plate. Namely, in this case the cutter plate 30 becomes a guide member which peels off the fibriform solid matter from the vane front edge 11 and sends them outward. The extent or performance of tearing of the solid matter is reduced in this case; however, the effect of preventing clogging is maintained. On the other hand, power required in cutting the solid matter is lessened and less wear of the vane front edge is experienced. Consequently, the wording "the cutter plate" according to this invention functionally includes or means guide plates means having a comparatively large clearance *h*. Only one cutter plate 30 normally suffices to accomplish the intended object; however, two or three cutter plates 30 (as shown in the figure) can be provided for a pump which is requested to tear solid matter more finely. Further, the clearance *h* can be made larger from the beginning. In this case, however, the plate becomes a guide plate having comparatively an inferior cutting performance.

According to a test result of the clearance *h* at the meeting portion taken as 0.5 mm, it is confirmed that, even if a towel or cotton cloth having comparable size flows into the pump, these cloths are torn into 20 - 30 pieces during passage through the pump. While in case of the clearance of 4 - 5 mm, the cloth of towel size is torn into 2 - 3 pieces in passage thereby. As seen from the above, in case where the cutter plate 30 is provided on the casing inner face 12 opposing the vane front edge 11, even comparatively large sized fibriform solids can be torn into small pieces and quickly discharged.

Due to rotation of the impeller, a metallic layer of sintered hard alloy provided on the front face of the vane front edge 11 and on the cutter blade 33 will pronouncedly improve the durability of these parts of the pump.

When the impeller 1 is adopted as shown in FIGS. 3 and 6, a pump is easily available having a suitable pumping head for respective servicing purpose without changing rotational speed thereof. That is, the vane outer perihery projecting into the water passage, which is originally as shown in FIG. 9*a*, is cut off to form a shouldered part as shown in FIGS. 9*b* and 9*c*, to reduce the vane outer diameter $H_3$ to such as $H_3'$ or $H_3''$. Thereby, the vane outer periphery 25 moves toward the central side as indicated at 25' or 25'' while maintaining the same height S; thus, the head change as shown in FIG. 10. The efficiency is kept almost unchanged in this case. The necessary power is reduced, because the vane outer diameter is reduced. According to the present invention as mentioned above, since the vane outer periphery is projected into the water passage, it becomes possible to freely change the head by only deviating the position of the vane outer periphery 25 toward the inside by means of lathe machining, etc.

While the principles of the invention have been described above in connection with specific embodiments, and particular modification thereof, it is to be understood that this description is made only by way of example and not as a limitation on the scope of the invention.

I claim:

1. A centrifugal sewage pump which comprises a semi-open impeller (1) with a disk-like shroud (4) fixed on a pump shaft (13) and plural impeller vanes (10) formed on the shroud (4) in one body, a front face (5) of the impeller shroud (4) facing water passages between impeller vanes (10), front face (5) provides hollows (8) depressing smoothly backward between an annular inner edge (6) and annular outer edge (7) thereof;

a shroud outer periphery (9) covered with a shroud ring (20) of a pump casing (2);

radial flow impeller vanes (10) each having a vane outer periphery (25) extending forward from an outer periphery (7) of the shroud front face (5), said vane having a smooth front edge (11) running from a front end (26) of said vane outer periphery to the front face inner edge (6), there being a clearance ($H_2$) between a front edge (11) of the radial flow impeller vanes (10) and a casing inner face (12) located in front of the impeller (1) and surrounding a suction port (17) for passing solid matter, and a height (S) of the vane outer periphery (25) being 30–70% of a water passage clearance ($H_1$), an axial distance between casing inner faces (12) (12″) at an impeller outlet in a casing 2, said piump being further characterized in that among portions of the shroud front face (5) divided by the radial flow impeller vanes (10), at least two portions (5′) and (5′) located at symmetrical positions have no or little backward depression.

2. The centrifugal sewage pump defined in claim 1 in which at least one cutter plate (30) is fixed to the casing inner face (12) facing the vane front edge (11) and arranged along a flow line opposing the vane front edge (11).

3. The centrifugal sewage pump defined in claim 2, in which an inner periphery (31) of the cutter plate (30) is smoothly continuous with an inner surface of a suction port (17) of the pump casing (2) located in front of and coaxial with the pump shaft (13) and extends tangentially with respect to the suction port (17) outwardly distance to the center line of the shaft (13) increasing smoothly as distance from the suction port (17) increases, and curving alongside the absolute flow path; an outer edge (32) of said cutter plate being closer to the axis of the impeller than the outer periphery of the impeller (1) and the inner edge (31) of the cutter plate being situated from 60° to 180° apart from a swirling-in motion portion (21) of a volute chamber (19) in the pump casing, the swirling-in portion being formed between the impeller vane outer periphery and casing (2) forming radially and narrowest portion of volute chamber (19), and providing a start point for revolution to the expelled sewage water from the impeller.

4. The centrifugal sewage pump defined in claim 2, in which the cutter plate (30) comprises a removable cutter blade (33).

5. The centrifugal sewage pump defined in claim 2, in which the vane front edge (11) opposing a cutter front edge has a layer of sintered hard alloy.

6. The centrifugal sewage pump defined in claim 1, in which a cut off shoulder is provided at each of the outer peripheries (25) of the spiral flow impeller vanes to augment a pumping head, the shoulder being located in front of shroud front outer peripheral edge (7), and being provided with smaller diameter than that of shroud outer periphery (9).

7. The centrifugal sewage pump defined in claim 1 in which a cutting edge is provided on the vane front edge (11).

8. The centrifugal sewage pump defined in claim 1, further characterized in that a large clearance for passing solid matter is provided in the swirling-in portion (21) of the volute chamber (19) between the vane outer periphery and the pump casing inner face, said clearance forming a radially narrowest portion of said volute chamber (19), and providing a start point for revolution to expelled sewage water from the impellers.

* * * * *